United States Patent [19]

Rowe, Jr. et al.

[11] 4,029,523

[45] June 14, 1977

[54] SOLVENT PHOSPHATIZING COMPOSITIONS YIELDING NON WATER SOLUBLE COATINGS

[75] Inventors: Edward A. Rowe, Jr.; William H. Cawley, both of Mentor, Ohio

[73] Assignee: Diamond Shamrock Corporation, Cleveland, Ohio

[22] Filed: Mar. 20, 1975

[21] Appl. No.: 560,377

[52] U.S. Cl. ..... 148/6.17; 148/6.15 R; 148/6.16; 252/170; 252/389 A; 252/396

[51] Int. Cl.[2] ..... C23F 7/10

[58] Field of Search ..... 148/6.15 R, 6.15 Z, 148/6.16, 6.17; 252/170, 389 A, 396; 134/38, 40

[56] References Cited

UNITED STATES PATENTS

| | | | |
|---|---|---|---|
| 2,408,155 | 9/1946 | Thornbury | 134/40 X |
| 2,857,298 | 10/1958 | Smith | 148/6.15 R |
| 3,063,877 | 11/1962 | Schiffman | 148/6.16 |
| 3,197,345 | 7/1965 | Vullo et al. | 148/6.15 R |
| 3,257,326 | 6/1966 | Fullhart et al. | 148/6.15 R |
| 3,306,785 | 2/1967 | Hitchcock | 148/6.15 Z |
| 3,361,598 | 1/1968 | Vullo et al. | 148/6.15 R |
| 3,391,084 | 7/1968 | York | 134/38 |
| 3,450,579 | 6/1969 | Rausch | 148/6.16 |

FOREIGN PATENTS OR APPLICATIONS

| | | | |
|---|---|---|---|
| 1,222,351 | 8/1966 | Germany | 148/6.15 R |

*Primary Examiner*—Ralph S. Kendall
*Attorney, Agent, or Firm*—John J. Freer

[57] ABSTRACT

A liquid phosphatizing composition, containing organic solvent such as 1,1,1-trichlorethane or trichlorofluoromethane, can provide phosphate coatings on metal articles. In addition to the organic solvent, the composition contains a phosphatizing proportion of phosphoric acid and a solubilizing liquid capable of solubilizing phosphoric acid in the organic solvent. Most critically, the composition contains water in an amount exceeding the proportion of phosphoric acid, yet, the water-containing liquid composition maintains liquid phase homogeneity. Phosphatized coatings of desirable water insolubility are obtained.

30 Claims, No Drawings

SOLVENT PHOSPHATIZING COMPOSITIONS YIELDING NON WATER SOLUBLE COATINGS

BACKGROUND OF THE INVENTION

Phosphatizing operations carried on in water have typically provided drawbacks, including sludging and the need for a multistep operation, to achieve dry, coated articles. In an early attempt to overcome such problems, as described in U.S. Pat. No. 2,515,934, from 1% to 7% of the commercial phosphoric acid 85% syrup was used in an organic mixture, rather than in water. Representative of these mixtures was a 50/50 blend of acetone and carbon tetrachloride. With the blend, only a few steps were needed for phosphatizing.

A different approach to overcoming the problems that are found in water-based phosphatizing systems, was taken in the process of U.S. Pat. No. 2,992,146. Therein, by means of special equipment, an aqueous phosphatizing solution was sprayed onto a metal article, while the article was being maintained in a vapor degreasing zone. The vapor degreasing zone contained the vapors from a chlorinated hydrocarbon such as trichlorethylene. The operation thereby permitted enhanced drying of panels after phosphatizing.

In subsequently developed phosphatizing operations that relied on using chlorinated solvents, the water solution for the phosphatizing was altogether eliminated. In typical operations, a metal article for phosphatizing might be dipped in a chlorinated hydrocarbon degreasing solution, then come in contact with a non-aqueous phosphatizing solution, and thereafter be returned to the clorinated hydrocarbon degreasing solution for a final rinse operation. Such operation has been described for example in U.S. Pat. No. 3,100,728 and 3,197,345. As also discussed in the U.S. Pat. No. 3,197,345, it was becoming recognized that there was a water-based process, also called an "aqueous" method of phosphatizing metal articles, and on the other hand a solvent-based process, which was therein noted as the "dry" process. The latter process typically employed a solution of phosphoric acid in a chlorinated hydrocarbon solvent. Since the compositions of the U.S. Pat. No. 3,197,345 relied on chlorinated hydrocarbons, the phosphatizing method used was the dry process and the useful compositions were substantially water-free compositions.

As early as in the U.S. Pat. No. 2,515,934 it was recognized that the commercial phosphoric acid would introduce a small amount of water into organic phosphatizing compositions. In the U. S. Pat. No. 3,197,345 teachings, it was regarded that substantially all of the water could be distilled from the phosphatizing path as the "dry" treatment progressed. Getting away from a dependence on phosphoric acid was also explored. From this, it was found that special organic phosphate complexes could be useful in the non-aqueous solutions. They had the advantage of providing protective coatings of enhanced corrosion resistance. This approach was taken in U.S. Pat. No. 3,249,471. Another approach to the dry process, or to the "non-aqueous" process as it was also called, and that was employed in U.S. Pat. No. 3,297,495, was the use of a high strength acid. In such patent, the acid used was preferably one of 96–100% phosphoric acid. This concentrated acid presented sludge problems, but these were overcome by employing special additives.

Other techniques, to maintain the non-aqueous phosphatizing process dry, included the use of drying agents such as magnesium sulfate and the use of powdered metals. These concepts have been discussed in U.S. Pat. No. 3,338,754. Therein it was emphasized that small amounts of water are detrimental to the phosphate coatings obtained from the non-aqueous phosphatizing solutions. It was also early recognized in the U.S. Pat. No. 2,515,934 that the presence of water in an organic phosphatizing system could lead to the formation of two liquid phases, with attendant problems developing. Phase separation, and especially with regard to the formation of a separate aqueous phase, was discussed in U.S. Pat. No. 3,306,785.

SUMMARY OF THE INVENTION

It has now been found that an organic phosphatizing composition can produce highly desirable coating when such composition is maintained in a more wet condition. An initial key ingredient for the composition is an organic solvent. A further critical ingredient, in addition to a phosphatizing proportion of phosphoric acid, is an amount of water exceeding such proportion of phosphoric acid. But such water is not present in sufficient amount to provide a liquid composition that does not retain liquid phase homogeneity. Moreover, it has now been found possible to increase the coating weight of the resulting phosphate coating, by increasing the water content of the phosphatizing composition well beyond a content of just minute amounts.

A further and most significant discovery, is the achievement of phosphatized coatings of extremely reduced water sensitivity. Because of this, phosphate coatings are now achieved wherein the coatings can be successfully topcoated with water based compositions. Such compositions can include aqueous chrome rinses. They can additionally include such coatings as water reduced paints and electrocoat primers. With the ingredients that are in the phosphatizing composition, including a solubilizing liquid capable of solubilizing the phosphoric acid in the organic solvent, a vapor zone may be achieved in connection with the phosphating solution, in which zone there is obtained enhanced rinsing.

From such vapor zone, on condensation, the liquid condensed from the zone can retain complete liquid phase homogeneity without phase separation. Thus, in these systems achieving enhanced rinsing, bath rejuvenation, for example, can be accomplished by introducing into the phosphatizing bath a uniform liquid. This liquid, in constituency, can be equated to the constituency of the vapor zone; it thus will be a homogeneous blend. The blend is amenable to preparation for storage and/or handling, without loss of liquid phase homogeneity, prior to use as bath replenishing liquid.

Broadly, the invention is directed to an organic phosphatizing composition having a continuous and homogeneous liquid phase. The composition is suitable for phosphatizing metal with a water-resistant coating, while the liquid phase contains water in minor amount. More particularly, the composition comprises an organic solvent providing liquid phase homogeneity with a solubilizing liquid, while being a non-solvent for a phosphatizing proportion of phosphoric acid in the composition, with the organic solvent being unreactive with phosphoric acid in the composition. The composition further comprises a solubilizing liquid capable of solubilizing phosphoric acid in the composition while retaining liquid phase composition homogeneity, such solubilizing liquid being unreactive with phosphoric acid in the composition. Further, the composition comprises a phosphatizing proportion of phosphoric acid, and water in an amount exceeding such proportion of phosphoric acid while being sufficient for the composition to provide a phosphatized coating of substantial water insolubility on a ferrous metal substrate in phosphatizing contact with the composition, and while retaining liquid phase homogeneity.

Another aspect to the invention is the process of providing a phosphate coating, of the nature described herein above, by contacting a metal surface with a composition having a continuous and homogeneous liquid phase and containing water in a minor amount, with the composition further containing substances as described herein above. Such process may further include contacting of the metal surface, before the phosphatizing, with vapors containing organic solvent, and may also include contacting, after the phosphatizing, of the coated metal surface with vapors containing organic solvent.

Additional aspects of the invention include any of the foregoing phosphatizing processes followed by an aqueous chromium-containing solution treatment of the phosphatized metal surface, plus any and all of the resulting coated metal surfaces resulting from any of such processes. Other aspects of the invention include a vapor-containing rinse zone, for rinsing phosphate coated panels that have been in contact with the phosphatizing liquid, with such zone comprising a mixture of organic solvent vapors, solubilizing liquid vapors and water vapor.

A still further aspect of the invention is a composition for sustaining phosphatizing from a phosphatizing liquid medium as above described. Such rejuvenating composition includes, in a homogeneous liquid blend, ingredients also found in the above-described, vapor-containing rinse zone.

DESCRIPTION OF THE PREFERRED EMBODIMENTS

The organic solvent, or "solvent constituency" as it is sometimes referred to herein, is typically commercially available material and may contain additional ingredients, although the use of more purified substance is contemplated. For example, commercial 1,1,1-trichloroethane may contain very minor amounts of stabilizers such as 1,2-butylene oxide, nitromethane and 1,4-dioxane. It is further contemplated to use blends of organic solvents. Preferably, each of the solvents in the blend will be non-flammable, and combined they will form an azeotrope. Alone or in combination these solvents are such as will not solubilize a phosphatizing proportion of phosphoric acid; this phosphoric acid insolubility will be characteristic of the solvent even at the boiling point, as for example of the azeotrope, at normal pressure. For suitable acid solubility, a solubilizing liquid is needed. The organic solvent will generally provide the major amount of the phosphatizing solution and will typically provide between about 60 to about 90 weight percent of such solution. However, this is not always the case. Most always, when the organic solvent does not form the major amount, the solubilizing liquid will be the predominant substituent in the solution. It is most preferable, for efficient phosphatizing composition preparation, that the organic solvent and the solubilizing liquid form storage stable blends. That is, that they form blends that on extended storage are free from phase separation.

Most preferably for efficient operation, the organic solvent is liquid at normal pressure and temperature and has a boiling point at normal pressure above about 35° C. Solvents that are contemplated for use are the chlorinated solvents such as 1,1,1-trichlorethane, fluorine-containing hydrocarbon solvents, e.g., trichlorofluoromethane, solvents containing only hydrogen and carbon, including aliphatic solvents such as n-heptane and aromatic liquids of which benzene is exemplary, as well as high boiling nitrogen-containing compounds which would include 2-allylpyridine, 2-bromopyridine, 2,3-dimethylpyridine, 2-ethylenepyridine and 1-tert-butylpiperidine, and further the aliphatic ketones, such as ethyl butyl ketone, having molecular weight above about 100 and below 200. Other useful organic solvents in addition to those mentioned hereinabove, and which can or have been used, include carbon disulfide, chlorobenzene, chloroform, 1,1,3-trichlorotrifluoroethane, perchloroethylene, toluene and trichloroethylene, as well as the inert and homogeneous liquid mixtures, of all the solvents mentioned herein, where such exist, as for example azeotropic mixtures. By being inert, it is meant that such mixtures do not chemically react with one another, or with other substituents of the phosphatizing composition, so as to retard or interfere with desirable phosphatizing operation of the composition. This characteristic of being inert carries through even at the temperature attained for the solution to be at boiling condition.

The solubilizing liquid needs to be one or a mixture that is capable of solubilizing phosphoric acid in the organic solvent while retaining composition homogeneity. The solubilizing liquid can also effect other characteristics of the phosphatizing solution, e.g., it may have an effect on the solubility of water in the phosphatizing solution. It is advantageous that the solubilizing liquid not create a readily flammable phosphatizing composition and that it be unreactive with phosphoric acid, i.e., not chemically react with the acid even at the composition temperatures achieved during phosphatizing operation. It is further preferred, for efficient phosphatizing operation, that the solubilizing liquid have a boiling point higher than the boiling point of the organic solvent, or that on boiling, it form an azeotrope with such solvent. The solubilizing liquid can be, and on occasion most desirably is, a blend of organic substances. Such blends are particularly useful for augmenting the solubility of water in the phosphatizing solution.

Particularly where the phosphatizing solution will be used as a liquid phosphatizing bath, at elevated temperature, thereby forming a rinse zone immediately above the bath that contains constituents of the bath in vapor state, it is desirable that the solubilizing liquid be present in such vapor. When phosphatized metal articles are removed from the phosphatizing bath into such rinse zone, one ingredient that may be present on the article for rinsing is phosphoric acid. Since the organic solvent even as a vapor in the rinse zone will exert little solubilizing activity towards the phosphoric acid, it is desirable to have vapor from the solubilizing liquid also present in the rinse zone.

Most advantageously for efficiency of operation the solubilizing liquid is an alcohol having less than six carbon atoms. Alcohols of six carbon atoms or more may be used, but should always be present in minor amount with at least one less than six carbon atom alcohol being in major amount. Representative alcohols that can be or have been used include methanol, ethanol, isopropanol, n-pentanol, n-propanol, n-butanol, allyl alcohol, sec-butanol, tert-butanol and their mixtures wherein liquid phase homogeneity is maintained when in mixture with organic solvent. However, additional substances, e.g., 2-butoxyethanol, can also be serviceable, alone or in combination with alcohol. As mentioned hereinabove, useful phosphatizing solutions can be achieved when the solvent provides the predominant constituent of the phosphatizing composition.

As discussed hereinabove, phosphoric acid will have only an extremely limited solubility in the organic solvent. However, this situation is obviated by using the solubilizing liquid. Therefore, although the phosphoric acid is a critical ingredient that is generally present in a very minor amount, with the solubilizing liquid present in the phosphatizing solution the phosphoric acid may be contained in the phosphatizing solution in substantial amount. Such amount might be up to 2–3 weight percent or more. But, for efficient and economical coating operation, the phosphoric acid is generally used in an amount below about one weight percent, basis total weight of the phosphatizing composition. A much greater amount than about 1%, will typically leave a coating on the metal substrate that is tacky to the touch. Preferably, for most efficient coating operation, the phosphoric acid is present in an amount between about 0.2–0.8 weight percent, basis the phosphatizing solution, although an amount below even 0.1 weight percent can be serviceable.

If it is contemplated that the phosphatizing solution will be used for the coating of metals that have been heretofore recognized as susceptible to phosphatizing, i.e., capable of readily reacting with phosphoric acid. Thus, it is contemplated that the phosphatizing solution will be useful for phosphatizing aluminum, zinc, cadmium and tin substrates as well as the more typical ferruginous metal substrates. The "phosphatizing proportion of phosphoric acid", as such term is used herein, may well be a "phosphatizing substance", as it might more appropriately be termed. That is, the use of such terms herein is not meant to exclude any substances that may be, or have been, useful in the solvent phosphatizing art for providing a phosphate coating. Such substances might thus include organic phosphate substance as well as the more typical acidic substances of phosphorous, e.g., the usual orthophosphoric acid. Further, it is contemplated that such substance include salts of such acids in phosphatizing. Since water is present in the phosphatizing solution in amounts greater than the phosphatizing substance, although concentrated acids are contemplated, e.g., phospholeum, the resulting solution contains the acid in dilution in water. Preferably, for economy, the orthosphosphoric acid is always the phosphoric substance used in the phosphatizing solution.

As mentioned hereinbefore, the amount of the phosphatizing substance in the phosphatizing solution is exceeded by the amount of water present in such solution. Water must be present in at least an amount sufficient to provide a phosphatized coating on ferrous metal of substantial water insolubility. As is discussed in greater detail hereinbelow, this means that the coating will be, at most, about 20% water soluble. On the other hand, water may typically be present in an amount as great as water saturation of the phosphatizing solution, at the temperature of phosphatizing. However, saturation is not exceeded as the solution will then lose liquid phase homogeneity. Homogeneity as used herein refers to solution uniformity free from liquid phase separation. When water separates, the separate water phase may attract phosphoric acid into such phase, to the detriment of further coating operation.

For many phosphatizing solutions of the present invention, on the one hand water insoluble coatings are achieved, coupled with an acceptable coating weight, when the water content of the solution reaches about one to two weight percent. On the other hand, phase separation for many solutions can occur when the water content reaches about 5–7 weight percent, basis total solution weight. Such is shown in greater detail, by reference to the Examples. But, since the solubilizing liquid can affect the ability of a phosphatizing solution to solubilize water, then especially those solutions wherein the solubilizing liquid predominates, may be solutions able to contain substantial amounts of water, for example 10–25 weight percent of water might be reached without achieving saturation. But the water will always provide a minor weight amount of the phosphatizing solution.

Water in the solution will exert a vapor pressure; the solution water content will thereby directly influence the water content of the vapor zone associated with the solution. When such zone is over a path of phosphatizing solution, a substantial amount of water vapor may retard the drying time of coated metal substrates that are phosphatized in the bath and then removed to the vapor zone for drying. Thus attention to the water content of a bath, when such might exceed about the 5–10 weight percent range is advisable. Since water is present in the phosphatizing solution in an amount in excess of phosphoric acid, it will most always be present in an amount within the range of about 1–6 weight percent.

Basic to the "phosphatizing solution" or "phosphatizing composition" as such terms are used herein, are the organic solvent, solubilizing liquid, phosphatizing proportion of phosphoric acid, and the water. A further substance that may be present in the phosphatizing solution is an aprotic organic substance. Although it is contemplated to use aprotic polar organic compounds for such substance, it is preferred for efficient coating operation to use dipolar aprotic organic compounds. These compounds act in the coating solution to retard the formation of an undesirable, grainy coating. The aprotic organic compound can also influence the level at which water saturation will occur in the phosphatizing compositions containing such compound, particularly when they are present in substantial amount. Although it is contemplated that such compound will always be present in minor weight amount of the phosphatizing solution, and generally present in an amount less than the amount of the solubilizing liquid, serviceable phosphatizing solutions can be prepared that contain on the order of ten to fifteen weight percent or more of such aprotic organic compound.

It is preferred, for extended retention of the aprotic organic compound in the phosphatizing solution during the phosphatizing operation, that such compound have a boiling point above the boiling point of the organic solvent in the solution. Preferably, for most extended presence in the coating solution, such compound boils at least about 20° C higher than the organic solvent.

The aprotic organic compound is often a nitrogen-containing compound; these plus other useful compounds include N,N-dimethyl formamide, dimethyl sulfoxide, acetonitrile, acetone, nitromethane, nitrobenzene, tetramethylenesulfone and their inert and homogeneous liquid mixtures where such exist. By being inert, it is meant that such mixtures do not contain substituents that will chemically react, in the phosphatizing solution, to retard disirable phosphatizing operation at the temperature attained for the solution to be at boiling condition. Dimethyl sulfoxide is useful as an aprotic organic compound; but, such may further be used as an accelerator compound, as is discussed herein below. In such case when the dimethyl sulfoxide is present as an accelerator compound, substance other than dimethyl sulfoxide is used to supply aprotic organic compound.

Another substance generally found in the phosphatizing composition is the organic accelerator compound. Such compound serves to increase the rate of formation of the coating during the phosphatizing process. Acceleration is accomplished without deleteriously affecting the nature of the coating, e.g., desirable uniform and non-grainy crystal structure for the coating. Serviceable compounds typically act in such manner even when present in the composition in very minor amount, as for example, in amount less than one weight percent basis total composition weight. Advantageously, for efficient operation, the accelerator compound has a boiling point greater than the boiling point of the organic solvent. Many of the useful accelerator compounds are nitrogen-containing organic compounds. More specifically, compounds that can be, or have been, used include urea, pyridine, thiourea, dimethyl sulfoxide, dimethyl isobutylene amine, ethylenediaminetetraacetic acid and dinitrotoluene.

The use of stabilizers has been taught in the prior art and such are contemplated for use herein, such as the hydrogen and hydrogen chloride acceptor substitutents that can retard the corrosive nature of phosphatizing compositions. Stabilizers against oxidation of a halohydrocarbon, for example, are also known. These might likewise assist in reducing the corrosive nature of the phosphatizing composition. Useful substances can include p-benzoquinone, p-tertiaryamyl phenyl, thymol, hydroquinone and hydroquinone monomethyl ether.

The phosphatizing composition is suitable for use with any of the phosphatizing operations that can be, or have been, used with solvent phosphatizing. Solvent phosphatizing operations can provide, quickly and efficiently, dry, coated metal substrates; and thus, such operations will most always provide for quickly achieving same. Sequentially, metal articles for phosphatizing may be typically degreased in degreasing solution and then immersed in a bath of the phosphatizing composition with such bath being most always heated to boiling condition. The phosphatized article, upon removal from the bath, might best then be maintained in the vapor zone above the bath for evaporating volatile constituents from the coated article to coating dryness. During such maintenance, the article may be subjected to a spray rinse. The phosphatizing composition may also be spray applied to a metal article, such as in a vapor zone that might be formed and/or replenished by vapor from the spray composition. Other contemplated aspects of successful operation include initial rinsing of a metal article with warm rinse liquid, e.g., immersion rinsing in such liquid, wherein the liquid is formed from the constituents of the vapor from the phosphatizing solution. Such rinsing is then followed by phosphatizing, and this can be further followed by an additional rinse in the warm rinse liquid. For efficiency in all operations, the temperature of the phosphatizing composition is maintained at boiling condition. In the ambient atmosphere adjacent to the phosphatizing solution, constituents of such solution may be present in the vapor state. For convenience, this atmospheric region is thereby termed the "vapor zone".

During phosphatizing, which will take place typically in decreaser apparatus, the vapor zone, in addition to containing trace amounts of other substances, will generally be found to contain organic solvent vapor, vapor from the solubilizing liquid that solubilizes the phosphoric acid in the organic solvent, as well as water vapor. Since such substances are to be expected as the chief ingredients of the vapor zone, they are the chief ingredients of the phosphatizing composition that can be expected to be lost from such composition as vapor loss. For efficient operation, it is therefore preferred to formulate a replenishing liquid composition containing organic solvent, solubilizing liquid and water. Further, such replenishing liquid can be used for sustaining the phosphatizing composition, and may form a homogeneous and storage-stable blend before use. Thus, for convenience, this liquid is often referred to herein as the "sustaining solution." The sustaining solution can be prepared ahead, for later use after storage and/or shipment.

In the make-up of the sustaining solution, the organic solvent will be the predominant ingredient; in the balance, the solubilizing liquid will supply the major amount, with water the minor amount. Generally, the solution will contain from about 70 weight percent, to greater than 95 weight percent, of organic solvent, with above about 2 weight percent, but not more than about 25 weight percent of solubilizing liquid. The water will most always be present in the sustaining solution in an amount of about 0.4–4 weight percent. Preferably, for enhanced phosphatizing operation, the water, solubilizing liquid and organic solvent will be combined in the sustaining solution in the equivalent proportions of such substances in the phosphatizing medium vapor zone. To efficiently prepare a homogeneous sustaining solution, it is preferred to first preblend the water with solubilizing liquid. Then the organic solvent constituency may be admixed with the preblend to quickly obtain a homogeneous sustaining solution. Additional ingredients, if present, are then generally added.

These additional ingredients will be present in the sustaining solution in very minor amounts. Typically these are present in combination in an amount less than about 1–2 weight percent based on the weight of the sustaining solution. Such ingredients can include accelerator compound, stabilizer compound, aprotic organic compound and phosphoric acid. However, where such sustaining composition is prepared for extended storage, the phosphoric acid is generally not included to avoid the use of special, acid-resistant containers. Preferably, for economy, the additional ingredients are each present in an amount less than about 0.1 weight percent.

As a pre-packaged blend, the sustaining solution in addition to being useful for sustaining, may have further utility in the make-up of a fresh phosphatizing composition. When using the sustaining solution for fresh solution make-up, it has been found that typical additional ingredients for the solution make-up may also be prepared ahead in a storage-stable and uniform blend. This additional blend will generally contain, as chief ingredients, solubilizing solvent, aprotic organic compound and water. Further, such additional blend will often contain accelerator compound and stabilizer compound. Such blend is often referred to herein simply as the "precursor composition." As a precursor composition to the make-up of a fresh bath, substances are generally simply mixed together for preparing this precursor composition and then the composition is packaged for storage and/or handling. Most usually, the solubilizing solvent will comprise the major amount of this precursor composition, and the water and aprotic organic compound may be present in substantially equivalent amounts. Additional ingredients, e.g., accelerator compound or stabilizer compound, are each often present in an amount less than one weight percent, basis the weight of such precursor composition. In a typical fresh bath make-up, the precursor composition and the sustaining solution, with one or both of such generally containing accelerator plus stabilizer, are mixed together, often for use in degreasing apparatus, with phosphoric acid being added during the blending. Thus, only these two solutions plus phosphoric acid need be on hand at the inception of phosphatizing solution make-up.

After coating formation on a metal article, the article may then proceed into a vapor zone that will be supplied and replenished by vaporized substituents from the phosphatizing composition. As discussed herein before, such vapor zone may have a highly desirable make-up of organic solvent vapor, water vapor and solubilizing solvent vapor as chief constituents. Typically, as in immersion phosphatizing, the coated article may be simply removed from the phosphatizing bath into the vapor zone, maintained in such zone until dry, and then removed for subsequent operation. The constituency of the vapor zone, in addition to often supplying a desirable rinsing medium, may also form, on condensation, a stable, uniform liquid blend. This phenomenon enhances the simplicity of recirculation systems, as when coating operation is handled in degreaser apparatus. Also, such recirculation systems can be adapted to have the recirculating, condensed vapor replenished with fresh sustaining solution, which solution has been discussed hereinabove, with the resulting replenished liquid then being recirculated to the phosphatizing solution medium.

The phosphatizing composition will typically provide a desirable phosphate coating, i.e., one having a weight of twenty milligrams per square foot or more on ferrous metal, in fast operation. Although contact times for ferrous metal articles and the phosphatizing composition may be as short as fifteen seconds for spray application, it will typically be on the order of about forty five seconds to three minutes for dip coating, and may even be longer. The coating weights, in milligrams per square foot, can be on the order as low as ten to twenty to be acceptable, i.e., provide incipient corrosion protection with initial enhancement of topcoat adhesion, and generally on the order of as great as one hundred to one hundred and fifty although much greater weights, e.g., three hundred or so, are contemplated. Preferably, for best coating characteristics including augmented topcoat adhesion and corrosion protection, the coating will be present in an amount between about 20–100 milligrams per square foot. Such coatings are readily and consistently produced with desirable coating uniformity.

The coatings that are obtained on ferrous metal will have at least substantial water insolubility, and hence are also termed herein to be "water-resistant" coatings. For determining water insolubility, the test employed is either a qualitative water-resistance test, or the more quantitative "water soak test". Both tests are described more specifically in connection with the examples. However, in general for the water soak test, or "water solubility test" as it is sometimes referred to herein, a coated ferruginous article is weighed and then immersed in distilled water. Upon removal from the water, it is rinsed in acetone and air dried. Subsequently, on re-weighting, the amount of water solubility of the coating is shown by any weight loss. This loss is generally expressed as a percentage loss of the total original coating. The method used for determining the original coating weight has been more specifically described in connection with the examples.

Advantageously, for enhanced corrosion protection, the coating will either be rated as passing the water-resistance test, or will be on the order of less than 20% water soluble as determined by the water soak test. Such a coating, for convenience, is often termed herein as a "phosphatized coating of substantial water insolubility". Preferably, for best coating performance, including the ability to receive topcoating with water-based topcoat compositions, the water solubility of the coating will be less than 5%, basic total weight of the original coating. In typical processing, the phosphatizing operation of the present invention will provide phosphatized coatings on ferruginous surfaces having virtually no water solubility as determined by the water soak test.

Because of the water resistant nature of the phosphate coating, the resulting coated metal substrates are especially adapted for further treatment with water based coating and treating systems. For example, the coated substrates may be further treated with acidified aqueous solutions typically containing a multivalent metal salt or acid in solution, such as a dilute solution of chromic acid in water. Such treating solutions can be the simplistic hexavalent-chromium-containing rinse compositions, including solutions of chromic acid and water that have been mentioned in U.S. Pat. Nos. 3,116,178 or 2,882,189, as well as their equivalent solutions such as the molybdic and vanadic acid solutions discussed in U.S. Pat. No. 3,351,504. Further, the treating solutions may be non-aqueous, it being contemplated to use chromic acid solutions such as disclosed in U.S. Pat. No. 2,927,046. The treatment can include solutions containing additional, reactive ingredients such as the combination of chromic acid and formaldehyde disclosed in U.S. Pat. No. 3,063,877. Additional treatments that are contemplated include the complex chromic-chromates from solutions typically containing trivalent chromium, as has been discussed in U.S. Pat. No. 3,279,958. Further treatments that can be used include such as the blended complex chromate salts disclosed in U.S. Pat. No. 3,864,175 as well as solutions containing salts of other metals, as exemplified in U.S. Pat. No. 3,720,547, wherein salts of manganese are employed in treating solutions. All of these treatments will generally provide a coating having a weight of from about 2 to about 40 milligrams per square foot or more. For convenience, these treatments and solutions collectively are sometimes referred to herein as "non-phosphatizing solutions for treating metal substrates".

The phosphatized coating also lends itself to topcoating from electrically deposited primers, such as the electrodeposition of film-forming materials in the well known electrocoating processes. Further, the phosphatized coatings can form the base coating for a water reducible topcoating. Such topcoating compositions typically contain solubilized polymers, similar to conventional alkyd, polyester, acrylic and epoxy types, that are typically solubilized with smaller amounts of organic amine. Also the resulting phosphate coated substrate can be further topcoated with any other suitable resin-containing paint or the like, i.e., a paint, primer, enamel, varnish or lacquer including a solvent reduced paint. Additional suitable paints can include the oil paints and the paint system may be applied as a mill finish.

Before applying the phosphate coating, it is advisable to remove foreign matter from the metal surface by cleaning and degreasing. Although degreasing may be accomplished with commercial alkaline cleaning agents which combine washing and mild abrasive treatments, the cleaning will generally include degreasing accomplished with typical degreasing solvents.

The following examples show ways in which the invention has been practiced but should not be construed as limiting the invention. In the examples all parts are parts by weight unless otherwise specifically stated. In the examples the following procedures have been employed.

Preparation of Test Panels

Bare steel test panels, 6 inch × 4 inch or unless otherwise specified, and all being cold rolled, low carbon steel panels are typically prepared for phosphatizing by degreasing for 15 seconds in a commercial degreasing solution maintained at its boiling point. Dry panels are removed from the solution, permitted to dry in the vapor above the solution and are thereafter ready for phosphatizing.

Phosphatizing of Test Panels and Coating Weight

Unless otherwise specified, cleaned and degreased steel panels are phosphatized by immersing the panels into hot phosphatizing solution maintained at its boiling point for one minute each. Panels removed from the solution pass through the vapor zone above the phosphatizing solution until liquid drains from the panel; dry panels are then removed from the vapor zone.

The phosphatized coating weight for selected panels, expressed as weight per unit of surface area, is determined by first weighing the coated panel and then stripping the coating by immersing the coated panel in an aqueous solution of 5% chromic acid which is heated to 160°–180° F. during immersion. After panel immersion in the chromic acid solution for 5 minutes, the stripped panel is removed, rinsed first with water, then acetone, and air dried. Upon reweighing, coating weight determinations are readily calculated. Coating weight data is presented in milligrams per square foot (mg/ft$^2$).

EXAMPLE 1

To 219.7 parts of benzene there is added, with vigorous agitation, 118.7 parts methanol, 3.64 parts ortho phosphoric acid, and 23.6 parts N,N-dimethylformamide. These blended ingredients are thereafter boiled for one hour using a reflux condenser and the solution is permitted to cool. The water content of the resulting boiled solution is found to be about 0.1 weight percent. This water content is directly determined by gas chromatograph analysis of a sample wherein the column packing is Porapak Q manufactured by Waters Associates, Inc. The resulting solution is then heated to boiling and panels are phosphatized in the manner described hereinabove.

Some of the resulting coated panels, selected in sets of two with each panel in the set being coated under identical conditions for the other panel in the set, are then subjected to testing. One panel in the set is used for coating weight determination in the manner described hereinabove. The other panel in the set is subjected to the water solubility test. For this test the panel is weighed and then immersed in distilled water for ten minutes, the water being maintained at ambient temperature and with no agitation. Thereafter, the test panel is removed from the water, rinsed in acetone and air dried. Subsequently, on reweighing, the amount of water solubility of the coating is shown by the weight loss. The loss, basis total original coating weight, is reported in the Table below as the percentage or degree, of coating loss.

Coating weights and water solubility of coatings, are determined initially for test panels that have been phosphatized in the above-described phosphatizing composition. Such data are determined thereafter for additional coated panels that have been phosphatized in compositions of differing water contents, all as shown in the Table below. These baths of varying water content are prepared in stepwise fashion by starting with the above-described bath, and then adding about one weight percent water to the bath followed by boiling the resulting solution for one hour. This procedure is repeated with additional water increments of one weight percent, as shown in the Table below. The phosphatizing coating operation for each bath of varying water content has been described hereinabove. For each phosphatizing bath, water content determinations are made prior to phosphatizing by the above-described method.

TABLE 1

| Coating Bath Water Content, Wt.% | Panel Coating Weight: mg/ft$^2$ | Degree of Solubility of Coating in Water |
|---|---|---|
| 0.1 | 18 | 82% |
| 1.1 | 28 | 11% |
| 2.1 | 26 | < 5% |
| 3.1 | 27 | < 5% |
| 4.1 | 21 | < 5% |
| 5.1 | 35 | < 5% |

The tabulated results demonstrate the enhancement in the degree of water insolubility for the phosphate coating as the water content in the phosphatizing bath increases. As determined by visual inspection, it is also noted that the degree of uniformity of the phosphate coating is increasing as the water content of the phosphatizing bath increases above about one percent. For the particular system of this Example, the desirable water content is deemed to be from about 1.5 weight percent to above 5 weight percent. At 1.1 weight percent and below, the degree of water solubility for the coated panels is regarded as being undesirable, since it can be easily improved. By continuing the stepwise water addition discussed hereinabove, this system is found to separate free water, i.e., lose liquid phase homogeneity, when the water content reaches 6.1 weight percent.

EXAMPLE 2

To 205.1 parts of n-heptane there is added, with vigorous agitation, 94.7 parts t-butanol, 3 parts ortho phosphoric acid and 17.3 parts N,N-dimethyl formamide. These blended ingredients are thereafter processed in the manner of Example 1 to prepare a phosphatizing solution having a water content of about 0.1 weight percent.

Degreased steel panels are phosphatized in the composition, all as discussed in Example 1. Additional phosphatizing compositions but having differing water contents, as shown in the Table below, are prepared as described in Example 1. The phosphatizing operation, for these baths of varying water content, is also as has been described hereinbefre. As shown in the Table below, for each phosphatizing bath, water content determinations are made prior to phosphatizing and coating weights and water solubility testing for coatings, are determined for all phosphatized panels.

TABLE 2

| Coating Bath Water Content, Wt.% | Panel Coating Weight; mg/ft² | Degree of Solubility of Coating in Water |
|---|---|---|
| 0.1 | 9 | 36% |
| 1.1 | 16 | < 5% |
| 2.1 | 26 | < 5% |

The tabulated results demonstrate the enhancement in the degree of water insolubility of the phosphate coating as the water content in the phosphatizing bath increases; further, visual inspection confirms that the degree of uniformity of the phosphate coating is enhanced along with insolubility of the coating. Also, desirably, the coating weight increases substantially when the water content of the bath is boosted to a significant amount. For the particular system of this Example, the desirable water content is deemed to be from about one weight percent to above two weight percent. By further water addition to the bath, this system is found to separate free water, i.e., lose liquid phase homogeneity, when the water content reaches 3.2 weight percent.

EXAMPLE 3

To 434 parts of trichloro trifluoroethane there is added, with vigorous agitation, 95 parts methanol, 2.7 parts ortho phosphoric acid and 17 parts N,N-dimethyl formamide. These blended ingredients are thereafter processed in the manner of Example 1 to prepare a phosphatizing solution having a water content of about 0.1 weight percent.

Degreased steel panels are phosphatized in the composition, all as discussed in Example 1. Additional phosphtizing compositions but having differing water contents, as shown in the Table below, are prepared as described in Example 1. Phosphatizing operation for each bath of varying water content is also as has been described hereinbefore. As shown in the Table below, for each phosphatizing bath, water content determinations are made prior to phosphatizing and coating weights and water solubility testing for coatings, are determined for all phosphatized panels.

TABLE 3

| Coating Bath Water Content, Wt.% | Panel Coating Weight; mg/ft² | Degree of Solubility of Coating in Water |
|---|---|---|
| 0.1 | 25 | 52% |
| 1.1 | 35 | 14% |
| 1.3 | 39 | < 5% |
| 1.4 | 37 | < 5% |

The results show the enhancement in the degree of water insolubility of the phosphate coating as the water content in the phosphatizing bath increases; also, visual inspection confirms that the degree of uniformity of the phosphate coating is increasing as the water content of the phosphatizing bath increases. For this particular system, the range for the desirable water content is quite narrow, with further water addition to the bath being found to separate free water when the water content reaches only 1.6 weight percent.

EXAMPLE 4

To 264 parts of 1,1,1-trichloroethane there is added, with vigorous agitation, 180 parts 2-butoxyethanol, 4.4 parts ortho phosphoric acid and 37.8 parts N,N-dimethyl formamide. These blended ingredients are thereafter processed in the manner of Example 1 to prepare a phosphatizing solution having a water content of about 0.1 weight percent.

Degreased steel panels are phosphatized in the composition, all as discussed in Example 1. Additional phosphatizing compositions but having differing water contents as shown in the Table below, are prepared as described in Example 1. Phosphatizing operation for each bath of varying water content is also as has been described hereinbefore. As shown in the Table below, for each phosphatizing bath, water content determinations are made prior to phosphating and coating weights and water solubility testing for coatings, are determined for all phosphatized panels.

TABLE 4

| Coating Bath Water Content, Wt.% | Panel Coating Weight; mg/ft² | Degree of Solubility of Coating in Water |
|---|---|---|
| 1.1 | 1 | N.A. |
| 2.1 | 154 | < 5% |
| 3.1 | 147 | < 5% |
| 4.1 | 315 | < 5% |

N.A. = Not Applicable

The tabulated results show a desirable range of water content for combining water insolubility of the phosphate coating with augmented coating weight. On visual inspection, no coating is detected at the 0.1 weight percent water level, i.e., the initial water level, which is thus not listed in the table since no degree of water solubility is attempted. Most dramatically. the coating weight can be significantly increased at elevated water content levels. At the 1.1 weight percent water level, the coating weight is so small as to deem water solubility of the coating as not applicable. By further water addition to the bath, this system is found to separate free water when the water content reaches 5.1 weight percent.

EXAMPLE 5

To 242.8 parts of toluene there is added, with vigorous agitation, 89.8 parts of isopropanol, 1.7 parts ortho phosphoric acid and 10.6 parts N,N-dimethyl formamide. These blended ingredients are thereafter processed in the manner of Example 1 to prepare a phosphatizing solution having a water content of about 0.1 weight percent.

Degreased steel panels are phosphatized in the composition, all as discussed in Example 1. Additional phosphatizing compositions but having differing water contents, as shown in the Table below, are prepared as described in Example 1. Phosphatizing operation for each bath of varying water content is also as has been described hereinbefore. As shown in the Table below, for each phosphatizing bath, water content determinations are made prior to phosphatizing and coating weights and water solubility testing for coatings, are determined for all phosphatized panels.

TABLE 5

| Coating Bath Water Content, Wt.% | Panel Coating Weight; mg/ft² | Degree of Solubility of Coating in Water |
|---|---|---|
| 0.1 | 8 | 30% |
| 1.1 | 10 | 25% |
| 2.1 | 19 | < 5% |
| 3.0 | 110 | 11% |
| 4.0 | 218 | 24% |

These results show that a low degree of water solubility is reached, but not maintained. This is an indication that modification of the system will be necessary to obtain an increasing coating weight, above about the 2.1 weight percent water level, which increase would be accompanied by a desirably low degree of water solubility. Boosting the amount of N,N-dimethyl formamide, or substituting a blend of methanol and isopropanol for the isopropanol constituency, or by doing both, might accomplish this for such systems having more than about 2.1 weight percent water, since the heavier coatings reported in the Table are seen by visual inspection to have a grainy appearance and feel tacky. However for the specific system investigated, the coating weight increases substantially. With further water addition, the system is found to separate free water at the 5.0 weight percent level for the water.

EXAMPLE 6

To 374.8 parts of trichloro trifluoroethane there is added, with vigorous agitation, 132.8 parts isopropanol, 2.55 parts ortho phosphoric acid, 15.1 parts N,N-dimethyl formamide and 0.35 part dinitrotoluene. These blended ingredients are thereafter processed in the manner of Example 1 to prepare a phosphatizing solution having a water content of about 0.1 weight percent.

Degreased steel panels are phosphatized in the composition, all as discussed in Example 1. Additional phosphatizing compositions but having differing water contents, as shown in the Table below, are prepared as described in Example 1. Phosphatizing operation for each bath of varying water content is also as has been described hereinbefore. As shown in the Table below, for each phosphatizing bath, water content determinations are made prior to phosphatizing and coating weights and water solubility testing for coatings, are determined for all phosphatized panels.

TABLE 6

| Coating Bath Water Content, Wt.% | Panel Coating Weight; mg/ft² | Degree of Solubility of Coating in Water |
|---|---|---|
| 0.1 | 6 | N.A. |

TABLE 6-continued

| Coating Bath Water Content, Wt.% | Panel Coating Weight; mg/ft² | Degree of Solubility of Coating in Water |
|---|---|---|
| 1.1 | 6 | N.A. |
| 2.1 | 84 | < 5% |
| 3.1 | 91 | 13% |
| 4.1 | 185 | 9% |

N.A. = Not Applicable.

For the system, a desirable balance between the degree of water solubility plus an increase in the phosphate coating weight is shown to be obtainable. Also, the coating weight increase is processing in the direction of the increase in water content of the coating bath and at an elevated level. Upon further water addition to the bath, this system is found to separate free water and thus lose liquid phase homogeneity at a water content of 5.1 weight percent.

EXAMPLE 7

To 350.4 parts of a 50/50, by weight, blend of methylene chloride and trichloro trifluoroethane there is added, with vigorous agitation, 122.7 parts methanol, 2.5 parts ortho phosphoric acid, 15.1 parts N,N-dimethyl formamide and 0.35 part dinitrotoluene. These blended ingredients are thereafter processed in the manner of Example 1 to prepare a phosphatizing solution having a water content of about 0.1 weight percent.

Degreased steel panels are phosphatized in the composition, all as discussed in Example 1. Additional phosphatizing compositions but having differing water contents, as shown in the Table below, are prepared as described in Example 1. Phosphatizing operation for each bath of varying water content is also as has been described hereinbefore. As shown in the Table below, for each phosphatizing bath, water content determinations are made prior to phosphatizing and coating weights and water solubility testing for coatings, are determined for all phosphatized panels.

TABLE 7

| Coating Bath Water Content, Wt.% | Panel Coating Weight; mg/ft² | Degree of Solubility of Coating in Water |
|---|---|---|
| 0.1 | 14 | 35% |
| 1.1 | 26 | 16% |
| 2.1 | 34 | < 5% |
| 3.1 | 39 | < 5% |
| 4.1 | 41 | < 5% |
| 5.1 | 46 | 12% |

Again, the degree of water insolubility of the phosphate coating is augmented as the water content in the phosphatizing bath increases, for the solvent blend system and until water saturation is approached. Water saturation is reached for this system and it loses liquid phase homogeneity when the water content reaches 6.1 weight percent.

EXAMPLE 8

To 486 parts of perchlorethylene there is added, with vigorous agitation, 237.4 parts methanol, 44.8 parts 2-butoxyethanol, 4.2 parts ortho phosphoric acid and 19.4 parts acetonitrile. These blended ingredients are thereafter processed in the manner of Example 1 to prepare a phosphatizing solution having a water content of about 0.1 weight percent.

Degreased steel panels are phosphatized in the composition, all as discussed in Example 1. Additional phosphatizing compositions but having differing water contents, as shown in the Table below, are prepared as described hereinbefore. As shown in the Table below, for each phosphatizing bath, water content determinations are made prior to phosphatizing and coating weights and water solubility testing for coatings, are determined for all phosphatized panels.

TABLE 8

| Coating Bath Water Content, Wt.% | Panel Coating Weight; mg/ft² | Degree of Solubility of Coating in Water |
|---|---|---|
| 0.1 | 14 | 13% |
| 1.0 | 16 | 33% |
| 2.0 | 18 | 23% |
| 3.0 | 20 | 6% |

For the system, a desirably low degree of water solubility is eventually obtained with the commercially important perchlorethylene solvent. This is achieved using a combination of organic solubilizing liquids, i.e., the methanol and 2-butoxyethanol. However, as the system separates free water at slightly above the 3 weight percent water level, this system is deemed to have only a narrow, suitable range for producing desirable coatings.

EXAMPLE 9

To 450.5 parts of perchlorethylene there is added, with vigorous agitation, 349.6 parts t-butanol, 87.3 parts acetonitrile, 58.4 parts water, 43.9 parts acetone, 10 parts phosphoric acid and 0.3 part dinitrotoluene. These blended ingredients are brought to reflux temperature.

Upon the heating of the solution, a cleaned and degreased steel panel is phosphatized in the resulting phosphatizing solution by immersing the panel into the hot solution in a manner described hereinabove, that is, on the page preceding Example 1, except that the panel is immersed in the hot solution for five seconds. The resulting coated panel is then subjected to a qualitative water solubility test, or "water-resistance" test. Experience has shown that the qualitative water-resistance test is a more stringent test for determining water solubility of the coating, when compared with the water solubility test described in Example 1.

In the qualitative water-resistance test, a paper towel is saturated with tap water and then vigorously hand rubbed across the coated face of a dry panel for about ten seconds. Thereafter, the portion of the towel in contact during the rubbing with the coating, is visually inspected for determining pick-up of the coating on the towel. Also, the moist test panel is permitted to dry, and then visually inspected for bare metal exposure. Such exposure is typically exhibited by a change in color of the panel coating, or by streaking on the panel surface. In the test, panels either pass or fail, with panels that pass being regarded, from experience in such testing, as capable of passing the water solubility test described in Example 1.

The panel coated as above-described is found to pass the qualitative water-resistance test. Thus, the phosphatizing solution, based on perchloroethylene and using a combination of dipolar aprotic compounds, is found to provide acceptable phosphatized coatings.

EXAMPLE 10

A series of three phosphatizing solutions are made up as follows:

Solution A is prepared by blending together 62.61 parts of trichloroethylene, 30.64 parts methanol, 4.3 parts water, 2.02 parts N,N-dimethylformamide, 0.39 part orthophosphoric acid and 0.04 part dinitrotoluene.

Solution B is prepared by blending together 69.88 parts chloroform, 22.41 parts ethanol, 4.44 parts N,N-dimethylformamide, 2.84 parts water, 0.38 part phosphoric acid and 0.05 part dinitrotoluene.

Solution C is prepared by blending together 55.83 parts chlorobenzene, 35.94 parts methanol, 4.75 parts N,N-dimethylformamide, 3.03 parts water, 0.4 part phosphoric acid, and 0.05 part dinitrotoluene.

Each of the solutions, A, B, and C are prepared in the manner of Example 9 and panels are coated in each of the solutions, as has been described in Example 9, except that for each solution the panel is immersed for two minutes. Panels from each of the solutions A, B, and C are then subjected to the qualitative water-resistance test described in Example 9. All of the tested panels are found to pass this water resistance test.

EXAMPLE 11

In the manner of Example 9, a phosphatizing solution is prepared from 494.3 parts ethyl butyl ketone, 334.7 parts methanol, 96.7 parts water, 62.8 parts N,N-dimethylformamide, 10.8 parts phosphoric acid, and 0.06 part dinitrotoluene. A cleaned and degreased steel panel is coated in this resulting phosphatizing solution as has been described in Example 9, excepting that the immersion time for the panel is two minutes. Thereafter, the panel is subjected to the qualitative water-resistance test described in Example 9, and is found to pass such test.

EXAMPLE 12

A phosphatizing solution is prepared in the manner of Example 9 from the following: 39.5 parts carbon disulfide, 24.6 parts t-butanol, 23.54 parts 2-butoxyethanol, 2.5 parts methanol, 6.89 parts water, 2.38 parts N,N-dimethylformamide, 0.56 part phosphoric acid, and 0.03 part dinitrotoluene. In the manner of Example 9, a clean and degreased steel panel is phosphatized by dipping into the solution for a period of two minutes.

Thereafter, the coated panel is subjected to the qualitative water-resistane test of Example 9. The coated panel is found to pass this test, for a coating from a phosphatizing solution containing several organic solubilizing liquids.

We claim:

1. An organic phosphatizing composition having a continuous and homogeneous liquid phase suitable for phosphatizing metal with a coating of at least substantial water insolubility, with said liquid phase containing water in minor amount, which composition comprises:

A. organic solvent providing liquid phase homogeneity, with an organic solubilizing liquid while being a non-solvent for a phosphatizing proportion of phosphoric acid in said composition, said solvent being unreactive with phosphoric acid in said composition;

B. solubilizing liquid capable of solubilizing phosphoric acid in said composition while retaining liquid phase composition homogeneity, said solubilizing liquid being unreactive with phosphoric acid in said composition;

C. a phosphatizing proportion of phosphoric acid;

D. aprotic polar organic compound soluble in said composition while retaining liquid phase homogeneity; and, E. water in an amount above about 2% and exceeding said proportion of phosphoric acid while being sufficient for said composition to provide a phosphatized coating of substantial water insolubility on a ferrous metal substrate in phosphatizing contact with said composition, and while retaining liquid phase homogeneity.

2. The composition of claim 1 wherein said solubilizing liquid is present in minor amount, basis weight of said organic solvent; and said aprotic polar organic compound is present in minor amount basis weight of said solubilizing liquid.

3. The composition of claim 1 wherein the aprotic organic compound is selected from the group consisting of N,N-dimethyl formamide, dimethyl sulfoxide, acetonitrile, acetone, nitromethane, nitrobenzene, tetramethylenesulfone and their inert and homogeneous liquid mixtures where such exist.

4. An organic phosphatizing composition having a continuous and homogeneous liquid phase suitable for phosphatizing metal with a coating of at least substantial water insolubility, with said liquid phase containing water in minor amount, which composition comprises:

A. organic solvent providing liquid phase homogeneity with an organic solubilizing liquid while being a non-solvent for a phosphatizing proportion of phosphoric acid in said composition, said solvent being unreactive with phosphoric acid in said composition;

B. solubilizing liquid capable of solubilizing phosphoric acid in said composition while retaining liquid phase composition homogeneity, said solubilizing liquid being unreactive with phosphoric acid in said composition;

C. a phosphatizing proportion of phosphoric acid;

D. aprotic polar organic compound soluble in said composition while retaining liquid phase homogeneity;

E. organic accelerator substance; and

F. water in an amount exceeding said proportion of phosphoric acid while being sufficient for said composition to provide a phosphatized coating of substantial water insolubility on a ferrous metal substrate in phosphatizing contact with said composition, and while retaining liquid phase homogeneity.

5. The composition of claim 4 wherein said accelerator substance is a nitrogen-containing organic compound.

6. The composition of claim 4 wherein said accelerator substance is selected from the group consisting of urea, pyridine, thiourea, dimethyl sulfoxide, dimethyl isobutylene amine, nitrated aromatic compounds containing the nitro group, ethylenediaminetetraacetic acid and mixtures thereof, with the proviso that when dimethyl sulfoxide is said accelerator compound, substance other than dimethyl sulfoxide supplies said aprotic polar organic compound.

7. A liquid composition having a continuous and homogeneous liquid phase suitable for phosphatizing metal with a coating of at least substantial water insolubility, with said liquid phase containing a fluorine containing hydrocarbon in mixture with water in minor amount, which composition comprises fluorine containing hydrocarbon, solubilizing liquid capable of solubilizing phosphoric acid in fluorine containing hydrocarbon, a phosphatizing proportion of phosphoric acid, and water in an amount above about 2% and exceeding said proportion of phosphoric acid, while being sufficient for said composition to provide a phosphate coating of substantial water insolubility on a ferrous metal substrate, and while retaining liquid phase homogeneity.

8. The composition of claim 7 wherein said solubilizing liquid is present in minor amount, basis weight of said fluorine containing hydrocarbon, and water is present in minor amount basis weight of said solubilizing liquid.

9. The composition of claim 7 wherein said fluorine containing hydrocarbon is selected from the group consisting of 1,1,3-trichlorotrifluoroethane, trichlorofluoromethane, and the azeotropic mixtures of the foregoing with other halogenated hydrocarbons.

10. A liquid composition having a continuous and homogeneous liquid phase suitable for phosphatizing metal with a coating of at least substantial water insolubility and enhanced uniformity, with said liquid phase containing a fluorine-containing hydrocarbon in mixture with water in minor amount, which composition comprises fluorine containing hydrocarbon, solubilizing liquid capable of solubilizing phosphoric acid in fluorine containing hydrocarbon, a phosphatizing proportion of phosphoric acid, aprotic polar organic compound, and water in an amount above about 2% and exceeding said proportion of phosphoric acid, while being sufficient for said composition to provide a phosphate coating of substantial water insolubility on a ferrous metal substrate, and while retaining liquid phase homogeneity.

11. The composition of claim 10 wherein the aprotic organic compound is selected from the group consisting of N,N-dimethylformamide, dimethyl sulfoxide, acetonitrile, acetone, nitromethane, nitrobenzene, tetramethylenesulfone and their inert and homogeneous liquid mixtures where such exist.

12. The composition of claim 11 wherein said solubilizing liquid is present in minor amount, basis weight of said fluorine containing hydrocarbon, and aprotic polar organic compound is present in minor amount basis weight of said solubilizing liquid.

13. A liquid composition having a continuous and homogeneous liquid phase suitable for phosphatizing metal with a coating of at least substantial water insolubility and of accelerated formation with enhanced uniformity, with said liquid phase containing a fluorine containing hydrocarbon in mixture with water in minor amount, which composition comprises fluorine containing hydrocarbon, solubilizing liquid capable of solubilizing phosphoric acid in fluorine containing hydrocarbon, a phosphatizing proportion of phosphoric acid, aprotic polar organic compound, organic accelerator substance, and water in an amount above about 2% and exceeding said proportion of phosphoric acid, while being sufficient for said composition to provide a phosphate coating of substantial water insolubility on a ferrous metal substrate, and while retaining liquid phase homogeneity.

14. The composition of claim 13 wherein said accelerator substance is selected from the group consisting of urea, pyridine, thiourea, dimethyl sulfoxide, dimethyl isobutylene amine, nitrated aromatic compounds containing the nitro group, ethylenediaminetetraacetic acid and mixtures thereof, with the proviso that when dimethyl sulfoxide is said accelerator compound, substance other than dimethyl sulfoxide supplies said aprotic polar organic compound.

15. The composition of claim 14 characterized by containing fluorine containing hydrocarbon, an alcohol having less than six carbon atoms, N,N-dimethyl formamide, phosphoric acid, dinitrotoluene and water.

16. A 1,1,1-trichlorethane and water-containing liquid composition having a continuous and homogeneous liquid phase suitable for phosphatizing metal with a coating of at least substantial water insolubility, with said liquid phase containing water in minor amount, which composition comprises 1,1,1-trichlorethane, solubilizing liquid capable of solubilizing phosphoric acid in 1,1,1-trichlorethane, a phosphatizing proportion of phosphoric acid, and water in an amount above about 2% exceeding said proportion of phosphoric acid, while being sufficient for said composition to provide a phosphate coating of substantial water insolubility on a ferrous metal substrate, and while retaining liquid phase homogeneity.

17. The composition of claim 16 wherein said solubilizing liquid is present in minor amount, basis weight of said 1,1,1-trichlorethane, and water is present in minor amount basis weight of said solubilizing liquid.

18. The composition of claim 17 characterized by containing 1,1,1-trichlorethane, phosphoric acid, water and solubilizing liquid selected from the group consisting of methanol, ethanol, isopropanol, n-pentanol, 2-butoxyethanol, n-proponal, n-butanol, allyl alcohol, sec-butanol, tert-butanol and their mixtures.

19. A 1,1,1-trichlorethane and water-containing liquid composition having a continuous and homogeneous liquid phase suitable for phosphatizing metal with a coating of at least substantial water insolubility and enhanced uniformity, with said liquid phase containing water in minor amount, which compositon comprises 1,1,1-trichlorethene, solubilizing liquid capable of solubilizing phosphoric acid in 1,1,1-trichlorethane, a phosphatizing proportion of phosphoric acid, aprotic polar organic compound, and water in amount above about 2% exceeding said proportion of phosphoric acid, while being sufficient for said composition to provide a phosphate coating of substantial water insolubility on a ferrous metal substrate, and while retaining liquid phase homogeneity.

20. The composition of claim 19 wherein the aprotic organic compound is selected from the group consisting of N,N-dimethylformamide, dimethyl sulfoxide, acetonitrile, acetone, nitromethane, nitrobenzene, tetramethylenesulfone and their inert and homogeneous liquid mixtures where such exist.

21. The composition of claim 20 wherein said solubilizing liquid is present in minor amount, basis weight of said 1,1,1,-trichloroethane, and aprotic polar organic compound is present in minor amount basis weight of said solubilizing liquid.

22. A 1,1,1,-trichlorethane and water-containing liquid composition having a continous and homogeneous liquid phase suitable for phosphatizing metal with a coating of at least substantial water insolubility and of accelerated formation with enhanced uniformity, with said liquid phase containing water in minor amount, which composition comprises 1,1,1-trichlorethane, solubilizing liquid capable of solubilizing phosphoric acid in 1,1,1-trichlorethane, a phosphatizing proportion of phosphoric acid, aprotic polar organic compound, organic accelerator substance, and water in an amount above about 2% and exceeding said proportion of phosphoric acid, while being sufficient for said composition to provide a phosphate coating of substantial water insolubility on a ferrous metal substrate, and while retaining liquid phase homogeneity.

23. The composition of claim 22 wherein said accelerator substance is selected from the group consisting of urea, pyridine, thiourea, dimethyl sulfoxide, dimethyl isobutylene amine, nitrated aromatic compounds containing the nitro group, ethylenediaminetetraacetic acid and mixtures thereof, with the proviso that when dimethyl sulfoxide is said accelerator compound, substance other than dimethyl sulfoxide supplies said aprotic polar organic compound.

24. The composition of claim 22 characterized by containing 1,1,1-trichlorethane, an alcohol having less than six carbon atoms, N,N-dimethyl formamide, phosphoric acid, dinitrotoluene and water.

25. The process of providing a water-resistant and adherent phosphate coating on the surface of a metal substrate, which process comprises bringing in to contact said surface with a phosphoric-acid-containing phosphatizing composition having a continuous and homogeneous liquid phase and containing water in minor amount, continuing said contact to effect formation of said coating on said surface, and separation said surface and said composition, wherein said phosphatizing composition comprises fluorine containing hydrocarbon, solubilizing liquid capable of solubilizing phosphoric acid in fluorine containing hydrocarbon, a phosphatizing proportion of phosphoric acid, and water in an amount above about 2% exceeding said proportion of phosphoric acid, while being sufficient for said composition to provide a water-resistant phosphate coating on said metal substrate, and while retaining liquid phase homogeneity.

26. The method of claim 25 futher characterized by withdrawing the coated surface from contact with said phosphatizing composition and passing same in to a vapor zone containing flourine containing hydrocarbon vapors, while permitting evaporation of volatile constituents from the coated surface in said vapor zone.

27. The process of providing a water-resistant and adherent phosphate coating on the surface of a ferrous metal substrate, which process comprises contacting said surface with a phosphoric-acid-containing phosphatizing composition havin a continuous and homogeneous liquid phase and containing water in minor amount, continuing said contact to effect formation of said coating on said surface, and separating said surface and said composition, wherein said phosphatizing composition comprises 1,1,1-trichlorethane, solubilizing liquid capable of solubilizing phosphoric acid in 1,1,1-trichlorethane, a phosphatizing proportion of phosphoric acid, and water in an amount above about 2% and exceeding said proportion of phosphoric acid, while being sufficient for said composition to provide a water-resistant phosphate coating on said ferrous metal substrate, and while retaining liquid phase homogeneity.

28. The method of claim 27 further characterized by withdrawing the coated surface from contact with said phosphatizing composition and passing same in to a vapor zone containing 1,1,1-trichlorethane vapors, while permitting evaporation of said volatile constituents from the coated surface in said vapor zone.

29. The method of preparing a coated metal substrate having on the surface thereof an adherent, corrosion-resistant and water-resistant coating, which method comprises:

A. contacting the metal surface with a liquid phosphatizing composition having a continuous and homogeneous liquid phase containing water in minor amount, continuing said contact to effect formation of a phosphatized coating on said surface and separating the resulting phosphatized metal surface and said composition, wherein said phosphatizing composition contains fluorine containing hydrocarbon, solubilizing liquid capable of solubilizing phosphoric acid in fluorine containing hydrocarbon, a phosphatizing proportion of phosphoric acid, and water in an amount above about 2% and exceeding said proportion of phosphoric acid while being sufficient for said composition to provide a water-resistant phosphate coating on said surface, and while retaining said liquid phase homogeneity; and, B. contacting the resulting phosphatized metal surface with a non-phosphatizing solution for treating metal surfaces.

30. The method of preparing a coated metal substrate having on the surface thereof an adherent, corrosion-resistant and water-resistant coating, which method comprises:

A. contacting the metal surface with a liquid phosphatizing composition having a continuous and homogeneous liquid phase containing water in minor amount, continuing said contact to effect formation of a phosphatized coating on said surface and separating the resulting phosphatized metal surface and said composition, wherein said phosphatizing composition contains 1,1,1-trichlorethane, solubilizing liquid capable of solubilizing phosphoric acid in 1,1,1-trichlorethane, a phosphatizing proportion of phosphoric acid, and water in an amount above about 2% and exceeding said proportion of phosphoric acid while being sufficient for said composition to provide a phosphate coating of substantial water insolubility on said surface, and while retaining said liquid phase homogeneity; and, B. contacting the resulting phosphatized metal surface with a non-phosphatizing solution for treating metal surfaces.

* * * * *

UNITED STATES PATENT AND TRADEMARK OFFICE

CERTIFICATE OF CORRECTION

PATENT NO. : 4,029,523

DATED : June 14, 1977

INVENTOR(S) : Edward A. Rowe, Jr. and William H. Cawley

It is certified that error appears in the above-identified patent and that said Letters Patent are hereby corrected as shown below:

Column 19, claim 4, line 46, after "amount", add -- above about 2% and --.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*